United States Patent [19]

Dillon et al.

[11] 4,135,639

[45] Jan. 23, 1979

[54] CLOSURE CONSTRUCTION

[75] Inventors: Glenn W. Dillon, Crete; Albert H. Lindell, Hazelcrest, both of Ill.

[73] Assignee: Stock Equipment Company, Cleveland, Ohio

[21] Appl. No.: 903,539

[22] Filed: May 8, 1978

[51] Int. Cl.[2] ..... B65D 41/04

[52] U.S. Cl. ..... 220/288; 285/203

[58] Field of Search ..... 220/288; 285/201-204

[56] References Cited

U.S. PATENT DOCUMENTS

| | | | |
|---|---|---|---|
| 1,947,425 | 2/1934 | Rieke | 285/203 |
| 3,791,021 | 2/1974 | Bauman | 285/203 X |
| 3,894,331 | 7/1975 | Ragettli | 285/203 X |

*Primary Examiner*—George T. Hall

*Attorney, Agent, or Firm*—Bosworth, Sessions & McCoy

[57] ABSTRACT

Disclosed are a closure construction for a container, such as a steel drum, embodying a flange member having an internally threaded opening adapted to be closed by an externally threaded cap, the flange member having an integral flange portion that is firmly secured in an offset portion of the container wall by means of spaced protuberances at the outer edge of the flange portion that are tightly engaged by the offset portion of the container wall, the protuberances being formed in the flange portion while the container wall adjacent the flange portion is secured against deformation, so that formation of the protuberances causes deformations of the container wall at and around the protuberances which firmly lock the flange member in place by engagement with the protuberances. Also disclosed are a method of making the closure construction, and apparatus for making it.

11 Claims, 11 Drawing Figures

FIG. 3
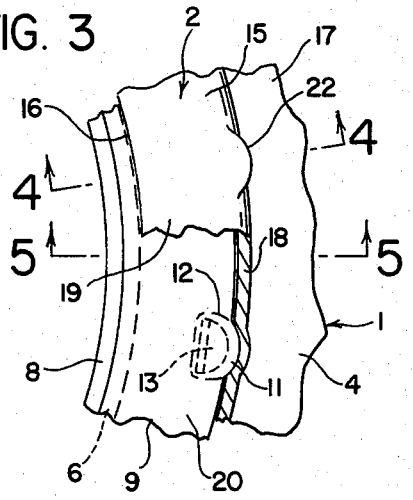
FIG. 4
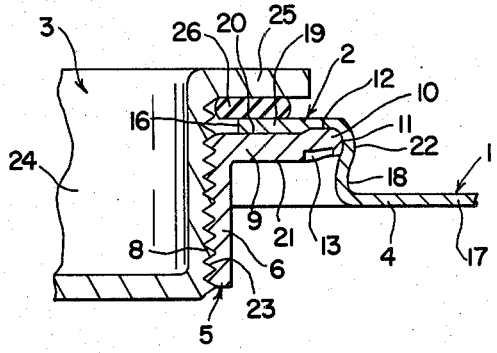
FIG. 5
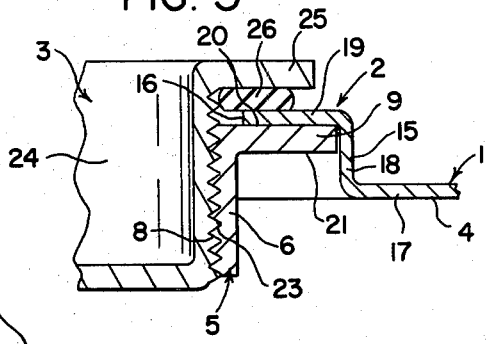
FIG. 6
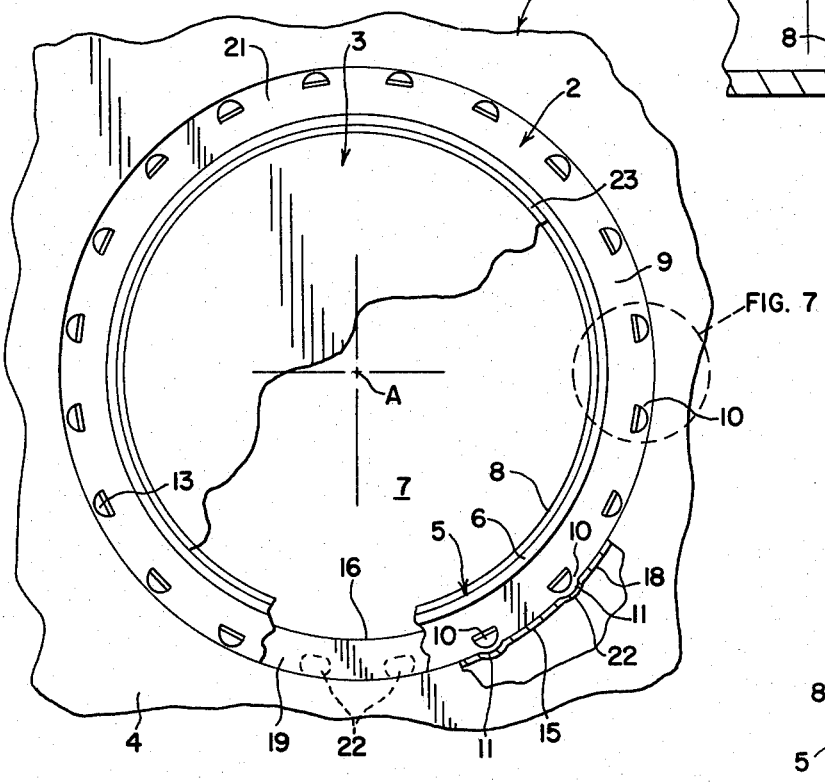
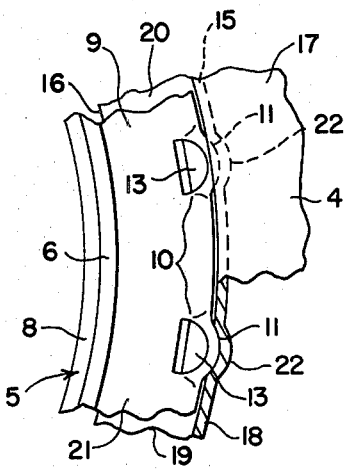
FIG. 7

CLOSURE CONSTRUCTION

FIELD OF THE INVENTION

This invention relates to container closure constructions for containers, adapted to be closed by removable closure members or caps, and to methods and apparatus for making such closure constructions. More particularly, the invention relates to closure constructions that may advantageously be used in metallic industrial containers such as steel drums and to methods and apparatus for making such closure constructions.

BACKGROUND OF THE INVENTION

In the manufacture of industrial containers, particularly in the manufacture of steel drums, it has long been the practice to provide the container a closure construction adapted to be closed by a closure member or cap, by mechanically securing within an opening formed in a wall of the container such as the end wall of a drum or barrel, an annular flange member having a radially extending flange portion and a previously helically threaded axially extending portion adapted to receive a threaded closure cap. Such a flange member should be firmly secured in the container wall so that on threading or unthreading of the cap the flange member will not loosen or turn in the container wall, and so that there is no leakage between the container wall and the flange member that could permit fluid contents to leak out of the container or external fluid to leak into the container at such location.

The flange member has its helical thread formed prior to installation of the member in the wall to avoid the problems of cutting or otherwise forming the thread in the flange member after it is fixed in the container wall which usually it is large and would be difficult or impossible to mount in apparatus for accurately forming a thread.

In installing such a flange member in an opening in a container wall, such as the end wall of a steel drum, it has usually been the practice in the past either to crimp the metal of the container wall beneath as well as over the outer edge of radially extending flange portion of a flange member by substantial radial forces applied to the metal of the container wall, or to clamp the edge of the opening of the container wall between a separate auxiliary ring portion and radially and axially extending portions of a flange member. Other constructions have also been proposed.

In general, however, all of these methods of securing the flange member to the container wall involve the application of substantial lateral or radial forces to either the radially extending portion of the flange member or to the axially extending portion of the flange member to deform suitably the metal of the container wall to grip the flange member.

The application of such substantial radial or lateral forces in general usually do not provide substantial difficulties where the opening in the flange member is and container wall are of relatively small diameters such as the 2-inch diameter opening commonly used in the flange members of closure constructions of steel drums, and where there is no need for a great degree of accuracy in the thread of the axial portion of the flange member because the threaded cap is manually applied or removed.

Moreover, for certain uses it has been found very desirable that it be possible to remove and replace the closure cap, without manual handling, from the threaded closure construction in a container.

For example, it is desirable in certain applications to package dangerous or toxic materials in closed containers, by remote control, without manual handling of the cap or without exposure of any human to the materials or emanations therefrom, by removing the cap from a container, holding the cap while the container has the material introduced into the container, and then threading the cap onto the closure construction and tightening the cap to form a tightly sealed closure, all without any manual handling of the cap.

To make this possible, it is necessary that there be a high degree of accuracy and freedom of distortion of the thread in the axially extending portion of the flange member of the closure construction, to permit such removal and replacement of the cap without manual handling.

Moreover, there has developed a need for containers such as steel drums with openings substantially larger than the 4-inch diameter opening usually provided in ordinary steel drums. In some cases it is desired to have an opening 4 inches in diameter, or even larger; and in other cases to have the closure construction so designed with an accurate thread so that even if the opening is of such large diameter the closure cap can be unthreaded and removed from the opening then re-inserted and threaded at the opening by mechanical means, without manual handling.

It has been found in general that in the heretofore known methods and apparatus for installing flange members of closure constructions into walls of steel containers, the radial forces imposed on the flange member are so great as to distort the flange member and its previously formed thread sufficiently to prevent removal and replacement of the cap without manual handling, particularly if the flange member and the opening through it are of relatively large diameter, as on the order of 4 inches or more.

Heretofore, to the best of applicants'knowledge, none of the methods and apparatus heretofore known for installing flange members in the walls of metal containers such as steel drums, can be successfully used to install and secure a large diameter flange member having a large diameter opening into a container wall without harmful distortion from the forces applied to the flange member in installing and securing the flange member in the container wall.

SUMMARY OF THE INVENTION

It is an object of the invention to provide a closure construction for metallic containers, and apparatus and a method of making such a closure construction, which are free of the above disadvantages and shortcomings.

It is a further object of the invention to provide method and apparatus of making such a closure construction which avoids, in securing the flange member to the container wall, the application to the flange member of any forces, radial or otherwise, that could harmfully distort the flange member or its previously formed thread, even though the flange member and thread are of large diameter.

The closure construction of the invention comprises a flange member having an axially extending portion with an axially extending opening and a thread and a radially extending flange portion with a periphery having at spaced intervals thereon protuberances that extend generally radially outwardly of the flange portion and that are formed by compressing the metal of the flange portion transversely thereof so that the metal is caused to deform and extend radially to form the protuberances and to be depressed within the periphery of the flange portion at the protuberances so that the depressed portions and the protuberances are of thinner cross section than the edge portions of the flange portion between the protuberances, and a container wall, to which the flange member is rigidly secured, including a major portion of the wall portion and a minor wall portion that is axially offset from the major portion and comprises a radially extending wall portion that contains an opening surrounding the axially extending opening of the flange member and that extends over the adjacent side of the flange portion of the flange member and over the protuberances, and an axially extending wall portion that is formed over and extends around and under the protuberances at the periphery of the flange portion to clamp them against the radially extending portion of said container wall to secure the flange member in the offset portion of said container wall, the axially extending portion of the container wall between the parts thereof engaging the protuberances being closely adjacent the periphery of the flange portion between the protuberances and the radially extending portion of the container wall closely engaging the flange portion over a substantial area.

The method of the invention comprises placing together a flange member having an axially extending portion with an axially extending opening and a thread and a radially extending metal flange portion, and a metal container wall having a major portion and a previously formed minor offset wall portion including an axially extending wall portion adapted to closely surround the outer periphery of the flange portion of the flange member and a radially extending wall portion having an opening adapted to surround the axially extending opening of the flange member and that bears against the adjacent surface of the flange portion of said flange member, then applying to the flange portion transversely thereof and axially of the flange member at spaced locations around the outer periphery of the flange portion compressive forces sufficient to form depressions in the metal of the flange portion and to force the metal of the flange portion outwardly to form generally radially extending protuberances while holding the radially extending portion of the offset portion of said container wall against the flange portion of said flange member and while constraining against outward radial movement the axially extending portion of the container wall at locations offset from the radially extending portion of the container wall and adjacent those at which said protuberances are formed whereby the metal of the container wall is deformed while said protuberances are formed to firmly engage said protuberances and extend around and under said protuberances and clamp them against said radially extending portion of said container wall thereby to firmly secure said flange member in said container wall.

The invention also includes apparatus comprising means for performing steps of the method to produce the closure construction of the invention.

BRIEF DESCRIPTION OF THE DRAWINGS

These and other features and advantages of the invention will become apparent from the disclosure of preferred embodiments of the closure construction, the method, and the apparatus of the invention in connection with the accompanying drawings in which:

FIG. 3 is a plan detail to a scale substantially greater than that of FIGS. 1 and 2 of the portion of the closure construction of the invention and its cap, indicated by the circular broken lines marked FIG. 3 in FIG. 2;

FIG. 4 is a section along line 4—4 of FIG. 3 and to the same scale;

FIG.5 is a section along line 5—5 of FIG. 3 and to the same scale;

FIG. 6 is a view from the bottom of the closure construction of the invention with the cap in place, to the same scale as FIG. 2, better to show the extending protuberances of the flange portion;

FIG. 7 is a detail to the same greater scale as FIG. 3 of the portion of FIG. 6 shown by the circular broken line marked FIG. 7;

DESCRIPTION OF PREFERRED EMBODIMENTS

Figure 1:
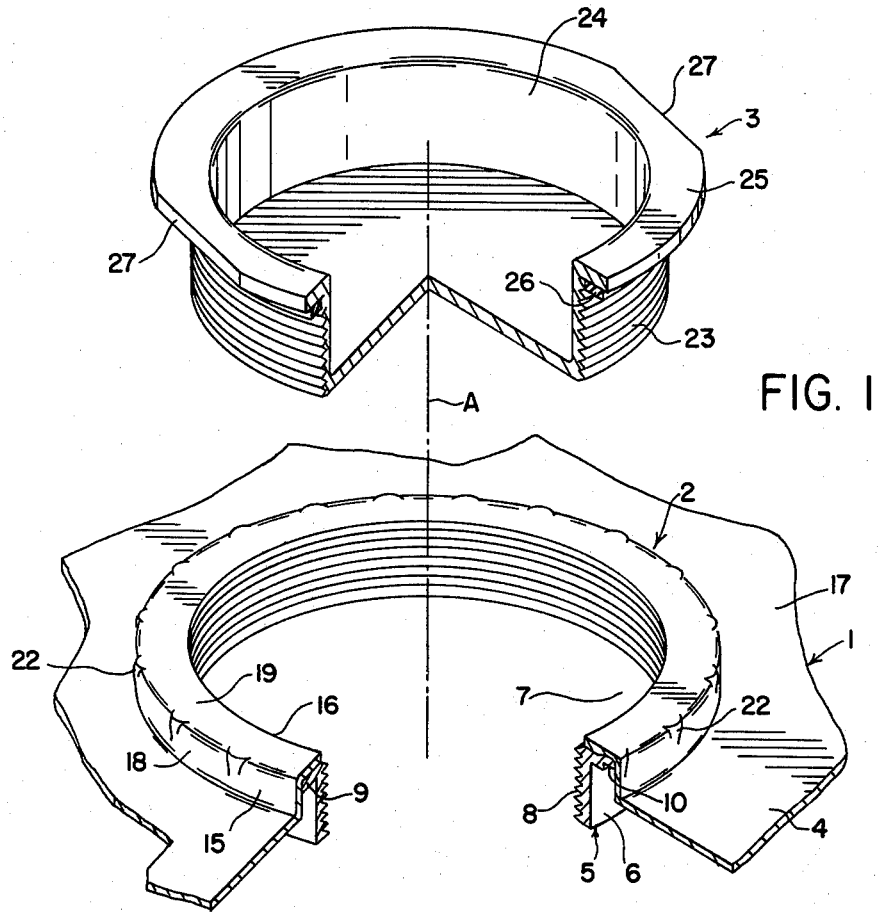
FIG. 1 is a perspective view of a preferred form of container closure construction embodying the invention, with a perspective view of a cooperating closure cap above it, parts being broken away from both the closure construction and the closure cap to show the structures thereof.
Figure 2:
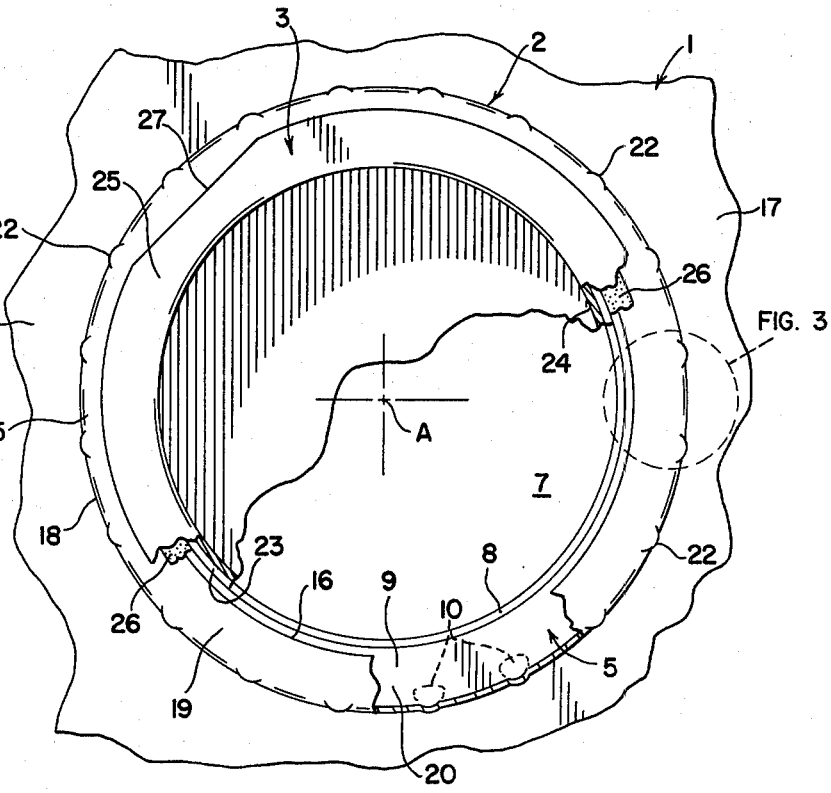
FIG. 2 is a plan of the closure construction of the invention with the closure cap in place, parts being broken away better to show their structures.

In FIGS. 1–7 illustrating a container having a preferred embodiment of the closure construction of the invention, container 1 has internally threaded closure construction 2 adapted to be closed by a separate removable externally threaded cap 3.

Closure construction 2 is rigidly secured in leak-proof relation to wall 4 of container 1 which wall may be the end wall of a steel drum. The illustrated closure construction comprises a flange member 5 including a circular axially extending portion 6 with a circular through opening 7 that has a preformed internal thread 8, all circular about an axis A, portion 6 being formed integral with a radially extending flange portion 9 by which the flange member is secured to wall 4. In the illustrated closure construction, flange portion 9 has a substantially circular periphery around which, at spaced perferably equal intervals, are radially extending protuberances 10, each formed as shown by compression and thinning of the metal of the flange portion edge so that at localized portions of the flange portion edge these protuberances extend radially at 11 (FIG. 7) beyond the circular periphery of the flange portion and preferably also axially at 12 (FIG. 4). Associated with each of these protuberances is a depression 13 extending within the periphery of the flange portion resulting from thinning of the metal in the formation of the protuberance, the metal of which is thinner than the remainder of the flange portion.

Wall 4 of container 1 (FIGS. 1–5) is formed with an offset portion 15, having an opening 16, extending from the main portion 17 of the wall. Offset portion 15 includes a generally circular axially extending wall portion 18 that closely fits the outer periphery of the flange portion, and a radially extending wall portion 19 including opening 16 surrounding opening 7 of member 5. Wall portion 19 extends over and closely engages the adjacent surface 20 of flange portion 9 of members 5 opposite surface 21 having depressions 13 and from which projects axially extending portion 6. At each protuberance 10, the localized portion 22 of axial wall portion 18 extends radially around the radially projecting portion 11 and partially under it, and over axially projecting portion 12 of the protuberance, as shown in FIG. 4, Between the protuberances, the axial portion 18 of the container wall is not deformed and extends generally parallel to axially extending portion 6 of the flange member, as shown in FIG. 5.

By this construction, flange member 5 is firmly gripped in container wall 4 against any movement, either rotationally, axially or laterally, relative to the container wall.

Internal thread 8 of flange member 5 is designed to mate with and be engaged by external thread 23 on cap 3 so that when the threads are screwed together the cap can close opening 7. Illustrated cap 3 is formed by pressing from a single piece of metal and has an axially extending wall 24 carrying external thread 23 and a radially extending flange portion 25 having on its underside that engages the closure construction 2 a suitable nonmetallic sealing ring 26 that aids in forming a fluid-tight seal. Flat portions 27 are shown at diametrically opposite edge portions of the cap flange to provide wrench-engaging portions, but other wrench-engaging means may be provided if desired.

As shown in FIGS. 4 and 5, the design of the closure construction is such that when cap 3 is screwed into the threaded opening 7 of flange member 5 and tightened, radially extending portion 19 of the container wall that overlies portion 9 of flange member 5 is clamped between flange portion 25 of the cap and flange portion 9 of the flange member thus aiding in forming a tight leak-proof joint and aiding in locking the flange member in place.

FIGS. 8 to 11 illustrate a preferred apparatus and process for securing the flange member 5 to the container wall 4. The apparatus comprises a lower stationary bed 28 and an upper vertically movable platen 29 of a known press apparatus 30. A lower pressing subassembly 32 is fixed to bed 28 and upper pressing subassembly 33 is fixed to movable platen 29.

Lower subassembly 32 comprises a base member 34 fixed to bed 28 by bolts 35 and an upper annular member 36 fixed to member 34 by bolts 37. Annular member 36 has a circular opening 38 having an axis A′ and sized to closely slidably fit the outer surface of axially extending portion 6 of flange member 5. Member 36 also has a laterally extending, preferably flat, circular top pressing surface 39 sized to fit within, and closely slidably fit within the axially extending portion 18 of container wall 4; the width of surface 39 is essentially, or exactly, the same as that of flange portion 9 of member 5. Member 36 also has a laterally extending, preferably flat, holding surface 40 that is offset from pressing surface 39 by the width of axially extending wall portion 18 of container wall 4. The axially extending outer surface 41 of member 36 between surfaces 39 and 40 is shaped to fit closely but slidably the inner surface of axial portion 18 of wall 4.

A movable pusher plate 42 is disposed in opening 38 and adapted to move in a guided upright path axially of the opening, being guided by a plurality of guide members 43 three being shown. Each guide member 43 constitutes a shaft slidable in a closely fitting hole 44 in member 34. The upper end of each shaft is fixed to plate 42 and its lower end has a shoulder 45 adapted to engage a shoulder 46 in member 34 to limit upward movement of plate 42. Plate 42 is biased upwardly by springs 47, three in the embodiment shown, located equidistantly between guide members 43.

Annular member 36 rigidly carries upright hardened steel pins 48 equal in number to the desired number of protuberances 10 to be formed in the final closure construction, the pins being located in member 36 outside of opening 38 at distances proper to form the desired protubernaces in the desired locations at the edge of the flange portion 9 of flange member 5. Each of these pins has an upper portion 49 that projects above surface 39 of annular member 36 and is shaped so that, as indicated later, the upper portion of each pin will deform the outer edge portion of flange portion 9 to form a protuberance in the desired location.

Lower subassembly 32 is adapted to have previously formed and threaded flange member 5 placed on it with its axially extending portion 6 coaxially in opening 38 of member 36, and with its flange portion 9 extending over and above the top surface 39 of member 36 and the upper portions of pins 48 and with the free end of the axially extending portion 6 of member 5 resing on pusher plate 42. A container wall 4 which has been previously formed to have offset portion 15 and opening 16 is placed over the flange portion of the flange member with its axial wall portion 18 closely and slidably fitting the outer circular periphery of flange portion 9 of the flange member, with its opening 16 surrounding opening 7 of member 5, and with its radial portion 19 extending over flange portion 9 of member 5 in contact with the surface 20 of flange portion 9 opposite the surface 21 from which axially extending portion 6 of the flange member projects.

The upper subassembly 33 carried by movable platen 29 of the press, on downward movement of the platen, is adapted to engage the outside of the axial wall portion 18 of container wall 4 at a zone below the location at which such wall portion can contact the outer periphery of flange portion 9 of flange member 5, and to hold the axial portion 18 against outward movement at such zone while subassembly 33 contacts the upper surface of the radial portion 18 of the container wall and forces such radial portion of the container wall and the flange portion 9 of flange member 5 downwardly to cause the outer edge of the flange portion 9 to be deformed by the upper ends of pins 48 to form protuberances 10 and cause them to project radially outwardly, forcing outwardly the metal of the container wall 4 in contact with such protruding portions while causing the remaining portions of the axial portion of the container wall to be retained in their original position, to cause the flange member 5 to be locked rigidly in the container wall 4.

Movable subassembly 33 comprises a base member 51 fixed to platen 29. Member 51 includes an annular portion 52 that extends downwardly toward lower stationary subassembly 32 and has rigidly fixed to it a hardened steel annular camming member 53 by engagement of offset surfaces 54 and 55 and bolts 56. Member 53 has a lower internal circular cross-sectioned camming surface 57 located and shaped for a purpose later described.

A central member 59 is rigidly fixed to member 51 by bolt 60. The central member has a lower external circular cross-sectioned camming surface 61 for a purpose later described, and a downwardly projecting portion 62 adapted to closely fit within the threaded opening 7 of flange member 5 mounted on lower subassembly 32, surrounded by a downwardly facing radially extending, preferably flat pressing surface 63 that extends radially outwardly from portion 62 for a distance sufficient to completely overlie radial portion 19 of offset portion 15 of wall 4. Movable holding members 64 are located in the lower portion of annular space 65 between camming member 53 and central member 59, the lower part of which space is defined by surfaces 57 and 61 which are preferably parallel as shown.

As shown in FIGS. 5, 8, 9, 10, these holding members are shaped and sized so as to occupy substantially the entire periphery of the portion of annular space 65 between surfaces 57 and 61, which portion of space 65 is inclined downwardly and diverges outwardly.

Figure 8:
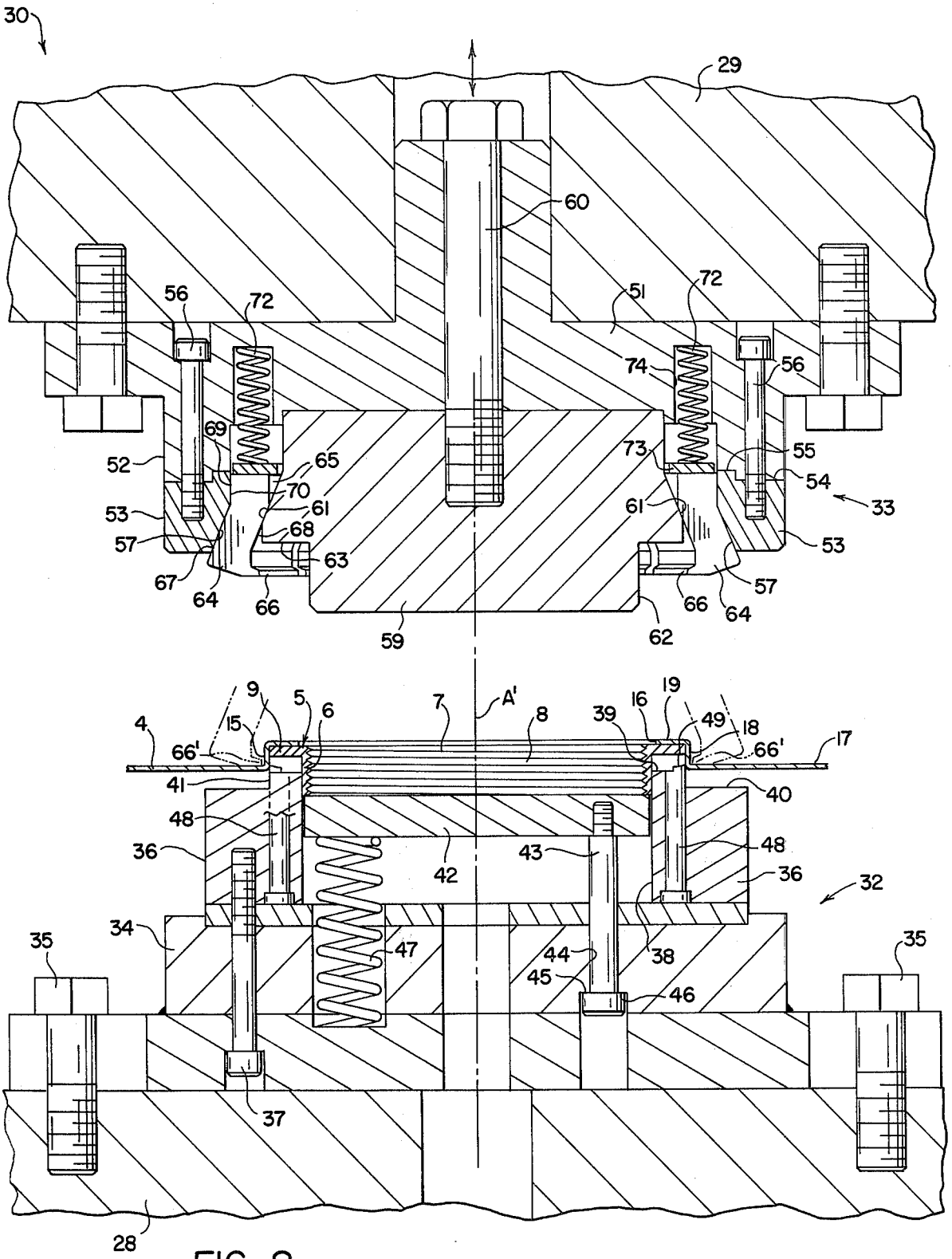
FIG. 8 is a sectional view, to a scale somewhat smaller than that of FIGS. 2 and 6 depicting a step in the illustrative method of the invention, before the application of the pressing forces.
Figure 9:
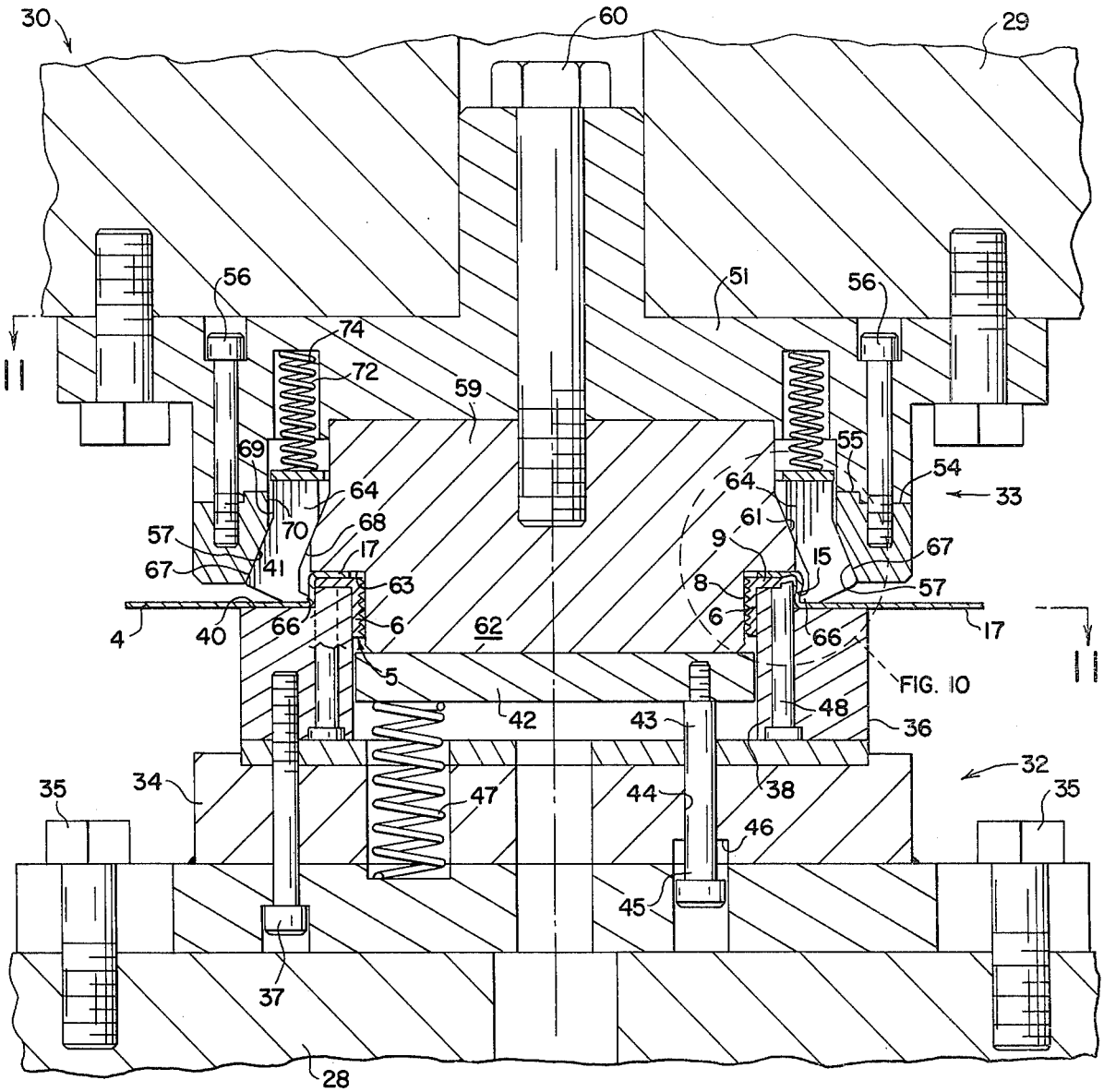
FIG. 9 is a view to the same scale as FIG. 8 illustrating another step in the illustrative method of the invention, according to which force is applied by spaced pressing members to the peripheral radial portion of the flange member to provide localized thinner portions of the flange portion that protrude radially of the flange portion, and also illustrating the crimping action applied by holding members around an axial portion of the container wall to clamp the container wall to the flange member.
Figure 10:
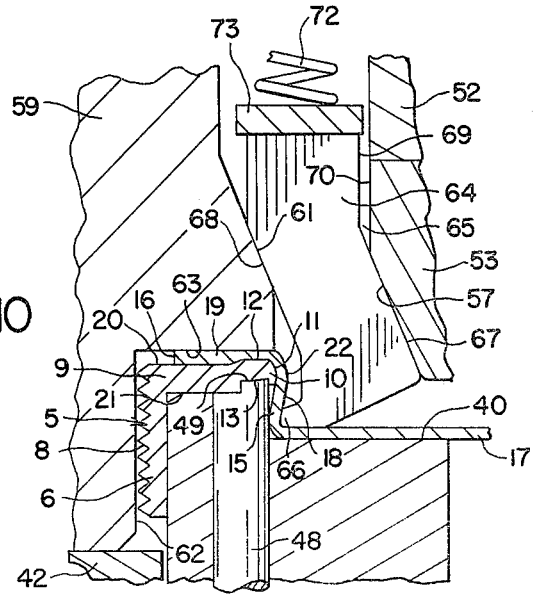
FIG. 10 is a detail to a scale greater than that of FIG. 9 of a portion of FIG. 9 indicated by the circular broken line marked FIG. 10.
Figure 11:
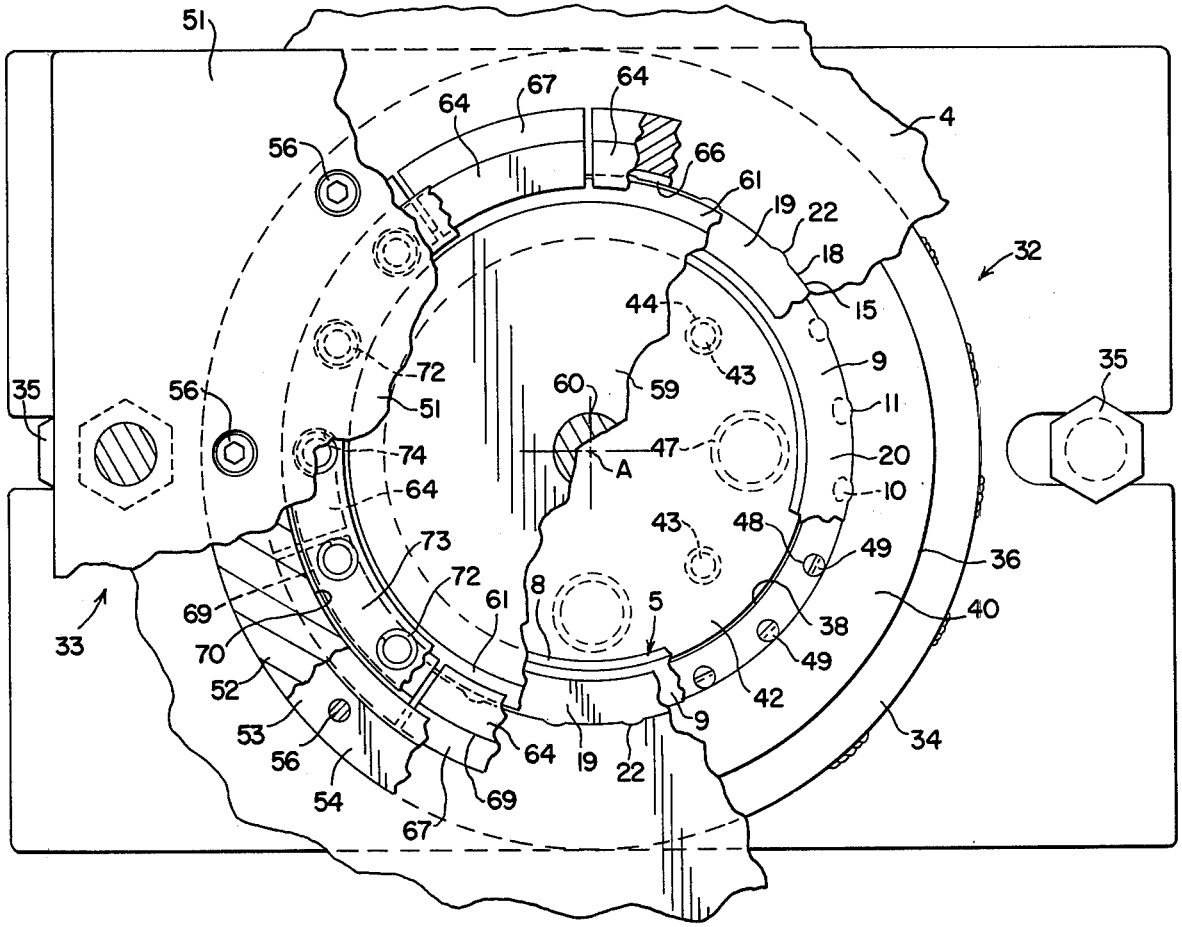
FIG. 11 is a section along line 11—11 of FIG. 9, and to the same scale, parts being broken away better to show the structure of the apparatus for securing the flange member to the container wall.

Movable holding members 64 have inwardly extending work-contacting edge portions 66 at their bottoms and have upwardly inclined surfaces 67, 68 that fit closely but slidably against the camming surfaces 57 and 61, so that before the subassembly 33 moves downwardly the holding members 64 initially are positioned sufficiently outwardly so their inner edges 66 can clear the outer surface of axial wall portion 18 of wall 4 as shown by broken lines 66' in FIG. 8, and after subassembly 33 moves downwardly and the members 64 engage the main portion 17 of the wall 4 they then move inwardly to the positions shown in full lines in FIG. 9.

Holding members 64 are also shaped so their downward movement is limited when subassembly 33 is entirely clear of the lower subassembly and a flange member on it. In the illustrated embodiment, this limiting action occurs because the holding members have outer surfaces 69 that extend generally vertically, and hence not at the same angle as surfaces 57 and 61; surfaces 69 contact a corresponding mating inner surface 70 on camming member 53, so that downward movement of the holding members 64 relative to the remainder of subassembly 33 is halted.

Holding members 64 are also biased downwardly and outwardly by compression-type springs 72 that contact a continuous spring seat ring 73 at the tops of the holding members, and also contact the bottom of annular slot 74 in base member 51. When the holding members 64 are biased to their maximum downward extent shown in the upper portion of FIG. 8, the inner edges 66 of the holding members are in their above-described outermost and lowermost positions.

When, as shown in FIG. 9, the upper subassembly 33 of the apparatus is moved downwardly, its projecting portion 62 first enters the opening 7 of flange member 5 which had previously been positioned on lower subassembly 32 as shown in FIG. 8. As downward motion continues, the bottom of portion 62 contacts the pusher plate 42 and depresses it against the force of springs 47, and the pressing surface 63 of central member 59 engages the top of the radial portion 19 of container wall 4 that overlies the top of flange portion 9 of flange member 5. Continued movement of subassembly 33 forces flange portion 9 of members 5 downwardly against the upper portions 49 of pins 48. This action causes the upper portions of the pins to deform the outer edge of the flange portion 9 of flange member 5 at spaced intervals determined by the locations of the pins and to thin down the edge portions of flange portion 9 to form depressions 13 and to cause protuberances 10 to protrude radially outwardly and axially as shown in FIGS. 4, 5, 9 and 10.

Futhermore, as subassembly 33 moves downwardly, the inner edges 66 of holding members 64 contact the main portion 17 of the container wall 4 near the intersection of the main flat portion of the wall and its axial portion 18, and further morement of subassembly 33 causes the holding members 64 to be forced upwardly into the portion of the annular space 65 defined by camming surfaces 57 and 61, to cause the inner edges 66 to contact the zone of axial portion 18 of wall 4 that is below flange portion 9 of member 5, and hold it firmly against the outer surface 41 of annular member 36 of lower subassembly 32, as shown in FIG. 9.

As the metal of the outer edge of the flange portion of flange member 5 is thus deformed by pins 48 it forces radially outwardly the metal of the container wall to form spaced protuberances 10 at the intersection of axial portion 18 and radial portion 19 of the offset portion 15 of the container wall 4 while the adjacent portion of the axial portion 18 of the container wall is held firmly in place against surface 41 of member 36 by inner edges 66 of holding members 64 as described above.

The result is, as shown in FIGS. 1–7, 9 and 10, that the edge of the flange portion 9 of flange member 5 is firmly locked into the offset portion 15 of the container wall at the locations of the protuberances. Because the protuberances extend radially, as well as axially, they prevent relative rotary motion between the container wall 4 and the flange member 5, as well as any other radial or axial movement.

After this operation, the upper subassembly 33 is then raised. Initially, this action permits the holding membes 64 to be forced outwardly in the angular portion of annular space 65 by springs 72 so that their lower holding edge portions 66 can clear the offset portion 15 of the container wal.l. Further retraction of the subassembly 33 causes the holding members 64 and projecting portion 62 of subassembly 33 to completely clear the closure construction 2 formed by the above described assembly of flange member 5 and container wall 4. The parts of subassembly 33 are then as shown in the upper portion of FIG. 8.

The completed closure construction 2 is then pushed upwardly by pusher plate 42 so it can then be removed from subassembly 32. Another separate flange member 5 and separate container wall 4 with a previously formed offset portion 15 can then be set in place as shown in the lower portion of FIG. 8, and the process be repeated.

Thus, a single axial stroke of the upper subassembly 33 of the apparatus forms the protuberances 10 in the outer edge of the flange portion 9 of the flange member 5 and also causes the offset portion 15 of container wall portion to be formed around the protuberances so as to rigidly and firmly lock the flange member in place in the container wall, without application to the flange member of radial forces that can distort the threaded opening 7 of the flange member. The fact that the metal of the container wall is substantially thinner than the thicker, stronger, and more rigid metal of the flange member promotes this advantageous action.

The container wall, of course, as in usual practice, can be an end wall of the drum which can thereafter be attached to a sidewall of a drum in any known manner.

The invention is particularly desirable in the formation of closure constructions having relatively large openings because it permits the installation of the construction in a container wall without harmful deformation of the flange member, but it can be also used advantageously in the manufacture of closure constructions of small openings, even those of the two-inch size widely used.

As indicated above, it is possible to make the closure construction of the invention with a fluid-tight metal-to-metal seal between the flange member and the container wall, without the necessity of using any non-metallic gasket or sealant between these parts to insure a fluid-tight seal. This results in savings in costs of manufacture and reduces the possibility of leakage due to subsequent failure of a gasket or sealant.

Further advantages arise out of the fact that since the parts of the closure construction of the invention are simple to manufacture, costs of the parts are substantially reduced as compared to such costs in other types of closure constructions. Furthermore, the costs of assembly of the parts into the closure construction, and the over-all costs of the tooling, can be substantially reduced, because of the simplicity of the tooling required and because formation of the protuberances and the clamping of the container wall to the flange at the protuberances is effected in a single operation requiring a single unit of press apparatus and minimal handling.

Although, as was indicated above, a very important advantage of the closure construction is that it lends itself to formation of closure constructions in which the threads of the flange member and closure do not jam or bind even though the closure construction has a large diameter opening thus making possible opening and closing of containers by remote control, closure constructions embodying the invention may be employed in a wide variety of containers for other purposes.

For example, a closure construction having a large diameter opening, such as a 4-inch diameter opening, may be used in many applications where open-headed drums are now used because it has been necessary to have a larger container opening than has heretofore been provided in commercially available drums that have only 2-inch diameter openings. Open-headed drums have been used in many applications because loading mechanisms often could not be used in a closure type drum which had the 2-inch opening which was the largest opening heretofore commercially available. Open-headed drums in general are also substantially more expensive than drums having a closure construction of the present invention with a large opening such as a 4-inch opening, and are more likely to leak than drums embodying large diameter closure constructions of the present invention. Drums embodying closure constructions of the present invention, therefore, are less expensive and safer than many types of drums which have heretofore had to be used because commercially available drums with 2" openings could not be used.

It is apparent that various modifications may be made in the disclosed closure construction and in the method and apparatus for making it, without departing from the invention. Thus, gaskets or sealants may be used at the junctures of the flange member and container wall if desired although in most if not all decanting they are not necessary. While the flange member 5 has been shown to have axially extending and flange portions of circular configurations, the invention could be applied to the installation in container walls of flange members having different configurations of these parts, although the circular configuration is the most desirable.

Although the invention has been disclosed in connection with the formation of closure constructions for steel drums, it can be employed for the formation of closure constructions for other types of containers.

While the invention has been shown and described with respect to certain specific embodiments, this is intended for the purpose of illustration rather than limitation and other variations and modifications than those indicated above will be apparent to those skilled in the art, all within the intended spirit and scope of the invention. Accordingly, the patent is not to be limited to the specific embodiments herein shown and described nor in any other way that is inconsistent with the extent to which the progress in the art has been advanced by the invention.

What is claimed is:

1. A closure construction for a container, comprising a flange member having an axially extending portion with an axially extending opening and a thread and, fixed to said axially extending portion, a radially extending flange portion that has a periphery having at spaced intervals thereon protuberances that extend generally radially outwardly of the flange portion and that are formed by compressing the metal of the flange portion transversely thereof so that the metal is caused to deform and extend radially to form said protuberances and to form depressed portions within the periphery of the flange portion at the protuberances so that said depressed portions and said protuberances are of thinner cross section than the edge portions of said flange portions between said protuberances, and a container wall to which said flange member is rigidly secured, said container wall including a major portion of the container wall and a minor portion of the container wall that is axially offset from said major portion and comprises a radially extending wall portion that contains an opening surrounding said axially extending opening of said flange member and that extends over the adjacent side of said flange portion of said flange member and over said protuberances and an axially extending wall portion that is formed over and extends around and under said protuberances at the periphery of said flange portion to clamp them against said radially extending portion of said container wall to secure said flange member in place in said offset portion of said container wall against movement relative to said container wall, said axially extending portion of said offset portion of said container wall between the parts thereof engaging said protuberances being closely adjacent the periphery of said flange portion between said protuberances and said radially extending portion of said offset portion of said container wall closely engaging said flange portion of said flange member over a substantial area.

2. The closure construction of claim 1 in which the surface of said flange portion of said flange member adjacent said radially extending portion of said offset portion of said container wall is essentially flat and the surface of said radially extending portion of said offset portion of container wall engaging said surface of said flange portion is essentially flat.

3. The closure construction of claim 1 in which said protuberances at the periphery of said flange portion of said flange member extend axially as well as radially of said flange portion, and in which said radially extending portion of said offset portion of said container wall is formed over and tightly engages said axially extending portions of said protuberances.

4. The closure construction of claim 3 in which the surface of said flange portion of said flange member adjacent said radially extending portion of said offset portion of said container wall is essentially flat except for said axially extending portions of said protuberances of said flange portion of said flange member, and the surface of said radially extending portion of said offset portion of container wall engaging said surface of said flange portion is essentially flat except where it engages said axially extending portions of said protuberances of said flange portion.

5. The closure contruction of claim 3 in which the material of said radially extending portion of said offset portion of said container wall is thinner at the locations where said radially extending portion of said container wall engages said axially extending portions of said protuberances.

6. The closure construction of claim 1 in which the periphery of said flange portion of said flange member is circular except at said protuberances and said axially extending and radially extending portions of said offset portion of said container wall are circular except at said protuberances.

7. The closure construction of claim 2 in which the periphery of said flange portion of said flange member is circular except at said protuberances and said axially extending and radially extending portions of said offset portion of said container wall are circular except at said protuberances.

8. The closure construction of claim 5 in which the periphery of said flange portion of said flange member is circular except at said protuberances and said axially extending and radially extending portions of said offset portion of said container wall are circular except at said protuberances.

9. The closure construction of claim 1 in which said axially extending portion of said flange member has an internal thread adapted to be engaged by the external thread of a closure cap.

10. The closure construction of claim 3 in which said axially extending portion of said flange member has an internal thread adapted to be engaged by the external thread of a closure cap.

11. The closure construction of claim 6 in which said axially extending portion of said flange member has an internal thread adapted to be engaged by the external thread of a closure cap.

* * * * *

UNITED STATES PATENT AND TRADEMARK OFFICE

CERTIFICATE OF CORRECTION

PATENT NO. : 4,135,639

DATED : January 23, 1979

INVENTOR(S) : Glenn W. Dillon and Albert H. Lindell

It is certified that error appears in the above-identified patent and that said Letters Patent are hereby corrected as shown below:

Column 2, line 21, change "4-inch" to --2-inch--.

Column 8, line 47, change "membes" to --members--.

Column 8, line 51, change "wal.l" to --wall--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*